US005515247A

United States Patent [19]

Cheung et al.

[11] Patent Number: 5,515,247

[45] Date of Patent: May 7, 1996

[54] ELECTROLUMINESCENT STRAP SUITABLE FOR RELEASABLY SECURING AN OBJECT TO A WRIST

[75] Inventors: Jacky Cheung, Richmond, Canada; Raymond W. M. Yeung, Hong Kong, Hong Kong

[73] Assignee: Alexander Sze Wai Chan, Hong Kong

[21] Appl. No.: 303,335

[22] Filed: Sep. 8, 1994

[51] Int. Cl.[6] ..... F21L 15/20

[52] U.S. Cl. ..... 362/84; 362/103; 362/108

[58] Field of Search ..... 312/103, 105, 312/108, 84, 106, 253, 189; 2/338

[56] References Cited

U.S. PATENT DOCUMENTS

| | | | |
|---|---|---|---|
| 3,153,745 | 10/1964 | Gurian et al. | 362/108 X |
| 3,729,923 | 5/1973 | Brigliano et al. | 362/103 X |
| 4,895,110 | 1/1990 | LoCascio | 362/108 X |
| 5,151,678 | 9/1992 | Veltri et al. | 362/189 X |
| 5,245,516 | 9/1993 | de Haas et al. | 362/84 X |

*Primary Examiner*—Denise L. Gromada
*Assistant Examiner*—Thomas M. Sember
*Attorney, Agent, or Firm*—Townsend and Townsend and Crew

[57] ABSTRACT

An electroluminescent strap (1) includes a web (2) of a flexible material having ends, the ends being securable to one another using a buckle member (4). An electroluminescent strip (14) having two broader sections (16) connected by a narrower waist section (18) is carried by the web. A watch or similar instrument (19) is secured to the strap over the narrower section.

3 Claims, 3 Drawing Sheets

ELECTROLUMINESCENT STRAP SUITABLE FOR RELEASABLY SECURING AN OBJECT TO A WRIST

BACKGROUND OF THE INVENTION

The present invention relates to an electroluminescent strap and in particular, to an electroluminescent strap suitable for releasably securing an object to a wrist.

U.S. Pat. No. 4,895,110 issued to LoCascio discloses an illuminated pet collar having a power source and a light source comprising an electroluminescent strip. U.S. Pat. No. 5,151,678 issued to Veltri et al. discloses a safety belt having an electroluminescent flexible strip which is activated by means of a power supply connected to the electroluminescent flexible strip. The devices disclosed in both the above patents require the connection of the relevant buckle parts in order to complete the circuit and permit the strap to be illuminated. Because the electric circuit which activates the strap in each instance must be closed at the connection points between the respective buckle parts such an arrangement is susceptible to malfunction as a result of, for example, water or moisture contamination, electrolytic corrosion or even oxidation of the contacts.

Another shortcoming of the above prior art is that the devices cannot be used for illumination purposes without first connecting them into a loop shape to thereby close the electrical circuit.

It is an object of the present invention to provide an electroluminescent strap suitable for releasably securing an object to a wrist wherein the aforesaid shortcomings are obviated.

BRIEF DESCRIPTION OF THE INVENTION

According to the present invention, there is provided a strap comprising (a) an elongate flexible web for placing around a wrist; (b) a buckle member secured to one end of the web including a buckle co-operable with the other end of the web to adjustable secure the web onto the wrist, the buckle member including at least first and second electrical connection points adjacent the web and means for supplying electrical power thereto; and (c) a flexible electroluminescent strip extending from the buckle member and secured to that side of the web outwardly visible when worn on the wrist, the strip having at the end adjacent the buckle member complementary connection points in electrical contact with said electrical connection points of the buckle member such that the strip may be illuminated when electrical power is supplied therethrough.

The contacts of the strap are preferably sealed to prevent ingress of contaminants such as water, moisture etc., and even air.

The electroluminescent strip may be generally broad and have a narrower "waist" portion adapted to lie behind the watch or similar instrument when such is mounted on or secured to the strap so that the strip in this region essentially provides for completion of the electrical circuit to the remote end of the strip relative to the buckle member.

To enhance visual effect, the illumination of the electroluminescent strap may be intermittent so as to provide a flashing effect.

DETAILED DESCRIPTION OF THE DRAWINGS

BEST MODE FOR CARRYING OUT THE INVENTION

Figure 1A:
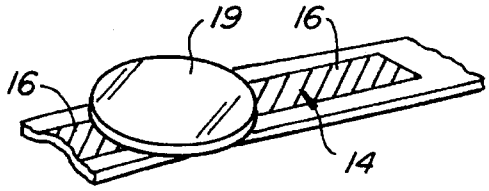
FIG. 1A is a fragmentary view of a strap shown with a watch or similar instrument.
Figure 1:
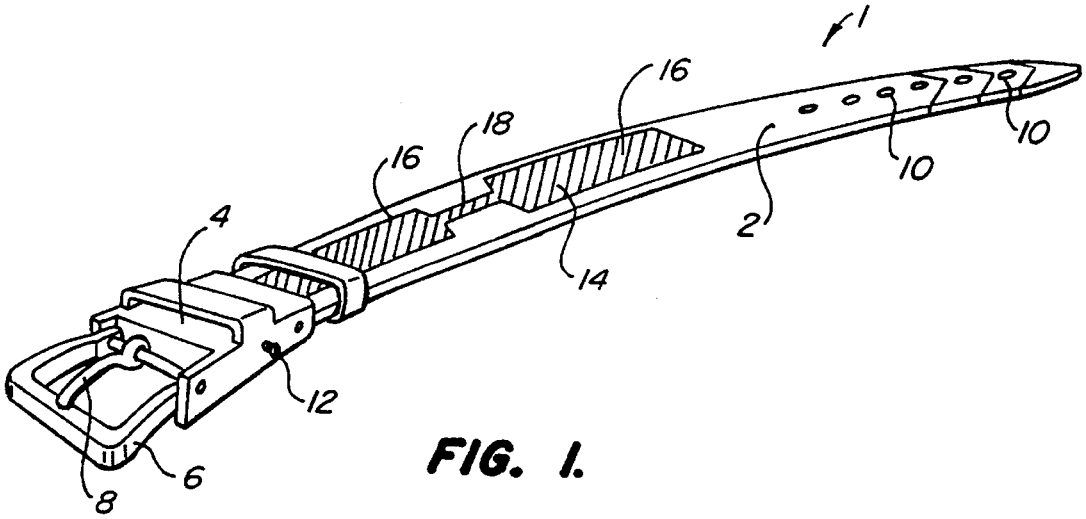
FIG. 1 is a perspective top and side view of a strap according to the present invention.

FIG. 1 shows a strap according to the present invention generally designated as 1. The strap 1 includes a web 2 made of flexible material, e.g. leather, artificial leather or plastic materials. One end of the web 2 is secured, in a way to be discussed later, to a buckle member 4. The buckle member 4 is provided at one end with a conventional buckle 6 with a movable tongue 8. When securing the strap 1 onto a wrist, the tongue 8 may be selectively inserted into one of several holes 10 provided at the other end of the web 2 in the usual manner. On one side of the buckle member 4 is a button 12 acting as an on/off switch for reasons to be discussed below.

Embedded within the web 2 is a flexible electroluminescent strip 14 having two broader sections 16 connected by a narrower waist section 18. It is intended, when in use, that the narrower section 18 lies substantially behind a watch or similar instrument 19 when such is mounted on or secured to the strap 1 such that the two broader sections 16 lie on the respective sides thereof but are nevertheless still part of the same electrical circuit.

Figure 2:
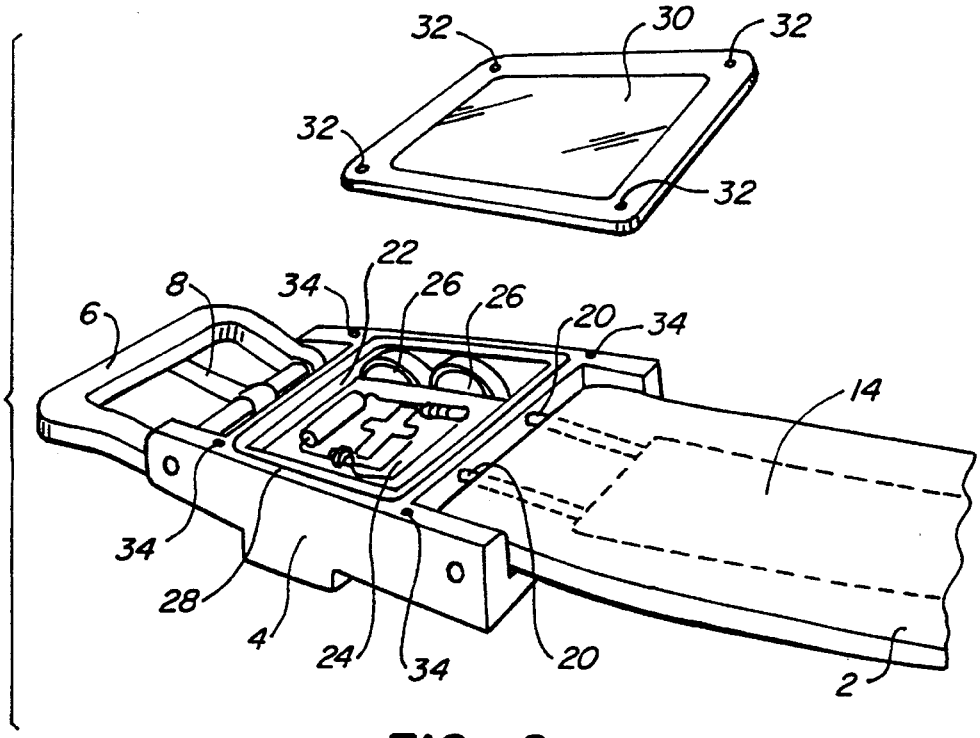
FIG. 2 is a partially exploded view of part of the reverse side of the strap of FIG. 1.

FIG. 2 shows the reverse side of the strap 1 on a larger scale and is a partially exploded view of the connection between the web 2 to the buckle member 4. As shown in FIG. 2, the web 2 is connected, in a way to be further discussed below, to the buckle member 4 via two metal connection elements 20 which are in electrical contact with the electroluminescent strip 14 embedded within the web 2. Within the buckle member 4 is a cavity 22 for housing a printed circuit board, generally designated as 24, powerable by batteries 26, for activating the electroluminescent strip 14 within the web 2.

Around the cavity 22 of the buckle member 4 is a rubber sealing ring 28 normally of a substantially circular cross-section. When assembled, a lid 30 is releasably secured onto the buckle member 4 by four screw means (not shown) via the holes 32 thereon and corresponding holes 34 on the buckle member 4. When the lid 30 is fully secured onto the buckle member 4, the rubber ring 28 will be under pressure and deformed such that ingress of such contaminants as water or moisture into the cavity 22 of the buckle member 4 is prevented.

Figure 3:
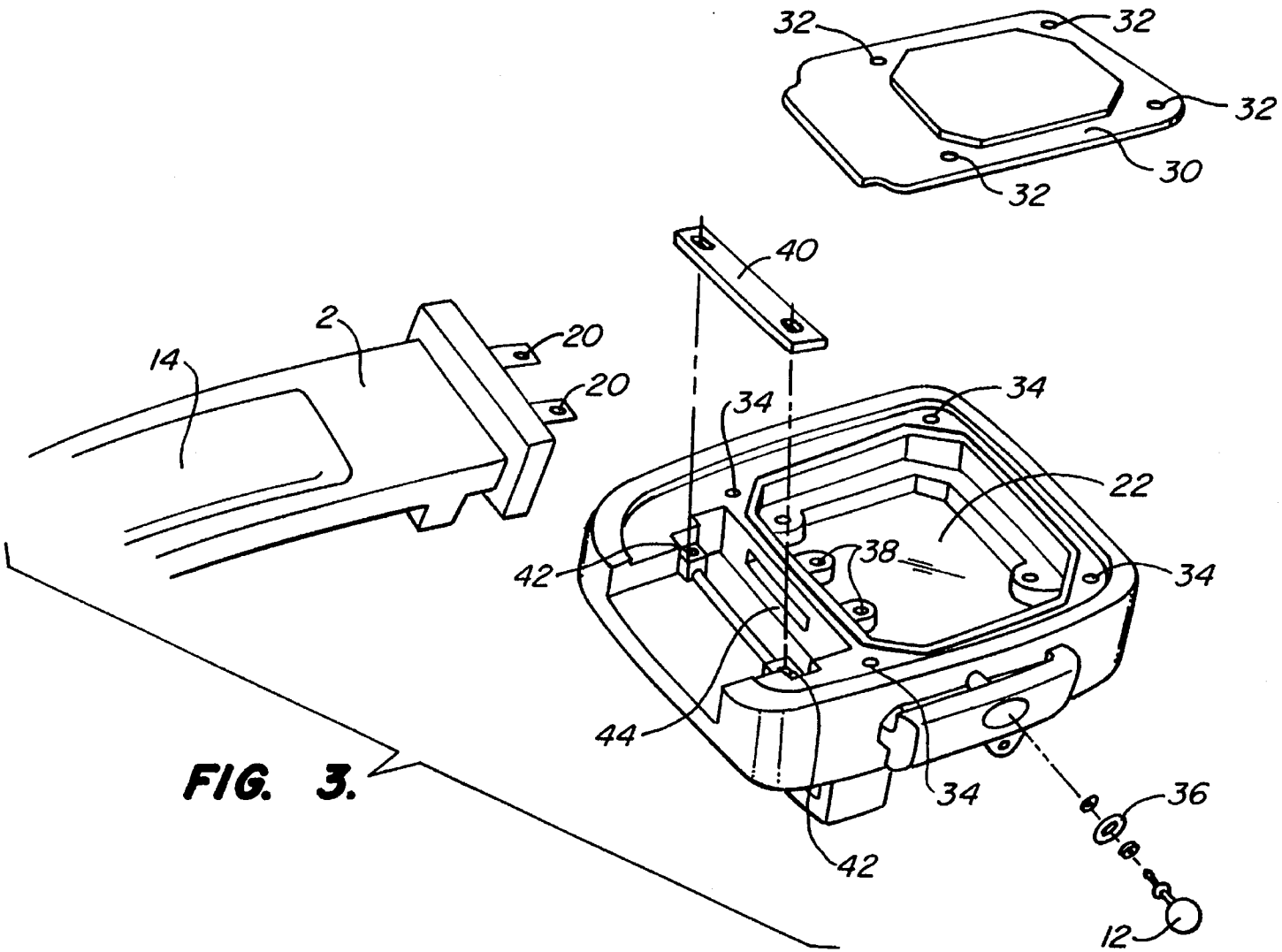
FIG. 3 is a further exploded view of the reverse side of the strap of FIG. 1.

Turning to FIG. 3, which is a further exploded view of the back side of the strap 1, there are shown the web 2, the lid 30, and the buckle member 4 with the buckle 6 and the movable tongue 8 removed for clarity purposes. The printed circuit board 24 and the batteries 26 are also not shown for the same reason.

FIG. 3 shows the button 12 discussed above with reference to FIG. 1 in more detail. In particular, to ensure that the buckle member 4 is waterproof, a rubber O-ring 36 is provided for preventing such contaminants as water or moisture from entering the cavity 22 of the buckle member 4 via the area where the button 12 joins the buckle member 4.

The connection elements 20 of the web 2 are electrically connected respectively to two complementary connection members 38 within the cavity 22 of the buckle member 4, for example, by screws. To avoid stressing of the connections between the connection elements 20 and the respective connection members 38 when the web 2 is bent, a bar 40 is secured onto raised portions 42 such that movement of the web 2 within the region between the raised portions 42 and wall member 44 is hindered. To further ensure the waterproof characteristic of the buckle member 4, after proper connection of the web 2 to the buckle member 4, the region between the raised portions 42 and the wall member 44 is then filled with an epoxy material.

Such an arrangement makes it possible to use the strap 1 in adverse conditions, such as under water, whilst still permitting the electroluminescent strip 14 to function normally, e.g. in a diver3 s wrist watch.

Figure 4:
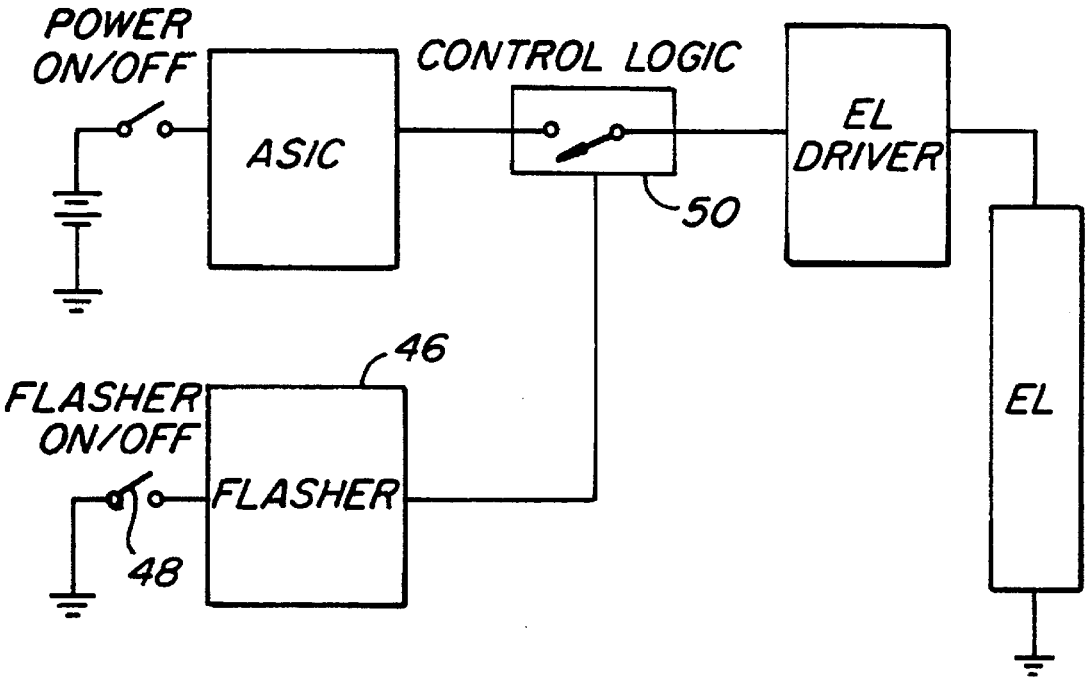
FIG. 4 is a diagram of a circuit enabling flashing of the electroluminescent strip.

In order to power an electroluminescent material by a DC power source, an inverter circuit is required for converting the DC into AC. FIG. 4 shows a modified circuit to that of a conventional inverter circuit, which allows a flashing effect to be achieved. A flasher 46 is included with a flasher switch 48 and a control logic 50, which control logic 50 allows selective activation of the flashing effect. The flasher 46 represents a periodic on/off switching timer with a preset time constant. When the flasher 46 operates, it drives the control logic 50 to interrupt the clocking data train output from the ASIC to the electroluminescent strip such that a flashing effect is achieved.

It should be understood that the above description only illustrates the best mode of carrying out the invention and there may be other variations to the invention which do not depart from the general inventive concept thereof. In particular, although the invention has been described with reference only to a strap suitable for placing around a wrist, it will be understood that this is not restrictive and a longer or shorter strap may be provided as described. Similarly, the strap may be used if preferred on its own and without securing a watch or similar instrument to the arm or other part of the wearer.

We claim:

1. A strap comprising:

(a) an elongate flexible web for placing around a wrist;

(b) a buckle member secured to one end of the web including a buckle co-operable with the other end of the web to adjustable secure the web onto the wrist, the buckle member including at least first and second electrical connection points adjacent the web and means for supplying electrical power thereto; and (c) a flexible electroluminescent strip extending from the buckle member and secured to a side of the web outwardly visible when worn on the wrist, the strip having at the end adjacent the buckle member complementary connection points in electrical contact with said at least first and second electrical connection points of the buckle member such that the strip may be illuminated when electrical power is supplied therethrough, the electroluminescent strip having a waist portion adapted to lie behind an instrument when such is secured to the strap.

2. A strap according to claim 1 wherein said contacts are sealed to prevent ingress of contaminants.

3. A strap according to claim 1 including flasher means wherein the illumination of the electroluminescent strap is intermittent when the flasher means is switched on.

* * * * *